US010385733B2

(12) United States Patent
Gobrecht et al.

(10) Patent No.: US 10,385,733 B2
(45) Date of Patent: Aug. 20, 2019

(54) METHOD FOR STARTING A STEAM TURBINE SYSTEM

(71) Applicant: Siemens Aktiengesellschaft, München (DE)

(72) Inventors: Edwin Gobrecht, Ratingen (DE); Jan Greis, Duisburg (DE); Matthias Heue, Bochum (DE); Tobias Hogen, Essen (DE)

(73) Assignee: Siemens Aktiengesellschaft (DE)

( * ) Notice: Subject to any disclaimer, the term of this patent is extended or adjusted under 35 U.S.C. 154(b) by 159 days.

(21) Appl. No.: 15/315,435

(22) PCT Filed: Apr. 30, 2015

(86) PCT No.: PCT/EP2015/059466
§ 371 (c)(1),
(2) Date: Dec. 1, 2016

(87) PCT Pub. No.: WO2015/197238
PCT Pub. Date: Dec. 30, 2015

(65) Prior Publication Data

US 2017/0096914 A1 Apr. 6, 2017

(30) Foreign Application Priority Data

Jun. 23, 2014 (DE) ..... 10 2014 211 976

(51) Int. Cl.
*F01K 13/02* (2006.01)
*F01K 7/22* (2006.01)
*F01K 7/16* (2006.01)

(52) U.S. Cl.
CPC ..... *F01K 13/02* (2013.01); *F01K 7/16* (2013.01); *F01K 7/22* (2013.01)

(58) Field of Classification Search
CPC . F01K 13/02; F01K 7/16; F01K 3/004; F01D 19/02
See application file for complete search history.

(56) References Cited

U.S. PATENT DOCUMENTS 3,601,617 A * 8/1971 Mello ..... F01D 17/00 290/40 C
4,226,086 A 10/1980 Binstock et al.
(Continued)

FOREIGN PATENT DOCUMENTS

DE 19848748 A1 4/2000
DE 102008029941 A1 5/2009
(Continued)

OTHER PUBLICATIONS

English Translation JP 58047105 A.*
International Search Report for PCT Application No. PCT/EP2015/059466, dated Jul. 20, 2015.

*Primary Examiner* — Mark A Laurenzi
*Assistant Examiner* — Shafiq Mian
(74) *Attorney, Agent, or Firm* — Schmeiser, Olsen & Watts LLP

(57) ABSTRACT

A method for starting a steam turbine system having a steam generator, a steam turbine which is connected to the steam generator and includes at least two turbine stages that, at the time of starting the steam turbine system, have different outlet temperatures, a condenser connected to the steam turbine and a consumer driven by the steam turbine, in which the steam generated in the steam generator is used to start the steam turbine, wherein, until the steam generated in the steam generator reaches a predetermined temperature that at least corresponds to the temperature requirement of the turbine stage with the higher outlet temperature, only the turbine stage with the lower outlet temperature is operated, and in that the turbine stage with the higher outlet tempera-
(Continued)

ture is brought on-line only once the predetermined temperature has been reached.

5 Claims, 1 Drawing Sheet

(56) References Cited

U.S. PATENT DOCUMENTS

| | | | | | |
|---|---|---|---|---|---|
| 4,518,207 | A * | 5/1985 | Gavronsky | E05C 19/006 | 312/107.5 |
| 4,693,086 | A * | 9/1987 | Hoizumi | F01K 7/22 | 60/663 |
| 4,744,723 | A * | 5/1988 | Hashimoto | F01K 7/24 | 415/1 |
| 4,873,827 | A * | 10/1989 | Hadano | F01K 7/22 | 60/646 |
| 5,361,585 | A * | 11/1994 | Westphal | F01K 7/24 | 60/646 |
| 7,028,479 | B2 * | 4/2006 | Gobrecht | F01D 19/02 | 60/646 |
| 9,803,504 | B2 * | 10/2017 | Park | F01K 13/02 | |
| 2003/0024248 | A1 | 2/2003 | Klatt et al. | | |
| 2011/0005225 | A1 * | 1/2011 | Namba | F01K 17/005 | 60/645 |
| 2012/0023945 | A1 * | 2/2012 | Ishiguro | F01D 5/082 | 60/646 |
| 2014/0165565 | A1 * | 6/2014 | Shindo | F01K 9/04 | 60/646 |

FOREIGN PATENT DOCUMENTS

| | | | | | |
|---|---|---|---|---|---|
| EP | 1 744 020 | A1 | | 1/2007 | |
| EP | 1992794 | A1 | | 11/2008 | |
| EP | 2 644 840 | A1 | | 10/2013 | |
| EP | 2644840 | A1 | | 10/2013 | |
| GB | 2 166 200 | A | | 4/1986 | |
| JP | 58047105 | A | * | 3/1983 | F01D 19/02 |
| JP | S58 47105 | A | | 3/1983 | |

* cited by examiner

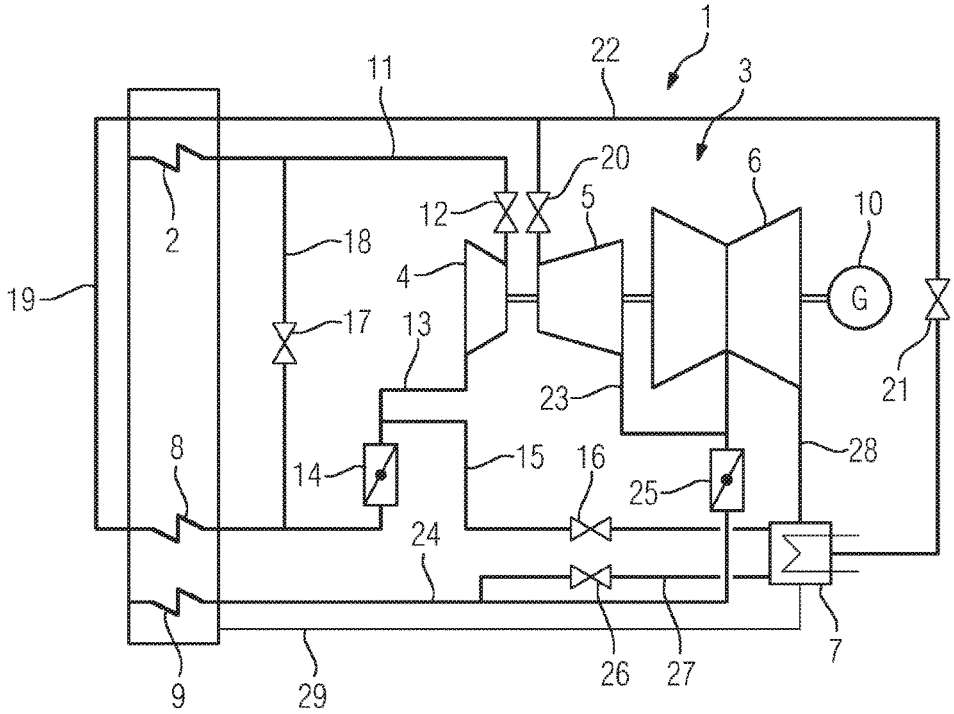
1
22
3
11
20
6
12
5
10
2
18
4
G
19
17
13
21
23
8
14
15
16
28
25
24
7
9
29
26
27

METHOD FOR STARTING A STEAM TURBINE SYSTEM

CROSS-REFERENCE TO RELATED APPLICATIONS

This application claims priority to PCT Application No. PCT/EP2015/059466, having a filing date of Apr. 30, 2015, based off of German application No. DE 102014211976.6 having a filing date of Jun. 23, 2014, the entire contents of which are hereby incorporated by reference.

FIELD OF TECHNOLOGY

The following relates to a method for starting up a steam turbine system having a steam generator, a steam turbine that is connected to the steam generator and comprises at least two turbine stages which have different starting temperatures when the steam turbine system is started, a condenser that is connected to the steam turbine, and a consumer which is driven by the steam turbine, in which the steam generated in the steam generator is used to start the steam turbine.

BACKGROUND

Various configurations of steam turbine systems are known. They include a steam turbine that is divided into multiple turbine stages. It is thus possible for example for a high-pressure stage, an intermediate pressure stage and a low-pressure stage to be provided. During operation of the steam turbine system, steam produced in the steam generator is supplied to the steam turbine, where it is expanded. This converts thermal energy into mechanical energy that is used to drive a consumer such as a generator.

The demands on steam turbine systems with regard to shorter and gentler start-up times during a hot start are ever-increasing. Normally, the steam turbine is charged with steam generated in the steam generator only once the steam has been heated to a temperature above that of the hottest turbine stage. Since, after a shutdown of the steam turbine system, the steam generated generally cools down faster than the respective turbine stages, this procedure lasts multiple minutes, leading to undesirably long delay times.

One known possibility for reducing this delay time consists in starting up the steam turbine system even when the steam temperature is still below that of the hottest turbine stage. This is in principle permissible if the steam temperature is raised rapidly enough. However, a consequence of this start-up method is a reduction in the service life of the steam turbine, which is to be avoided.

SUMMARY

An aspect relates to providing an alternative method for starting up a steam turbine system of the type mentioned in the introduction, enabling a hot start with short delay times without shortening the service life of the steam turbine.

In order to achieve this aspect, the embodiment of the present invention provides a method for starting up a steam turbine system of the type mentioned in the introduction, which is characterized in that only the turbine stage having a lower starting temperature is operated until the steam generated in the steam generator reaches a predetermined temperature which corresponds at least to the temperature requirement of the turbine stage having a higher starting temperature, and in that the turbine stage having a higher starting temperature is switched on only once the predetermined temperature has been reached. Thus, according to embodiments of the invention, during start-up first only the colder turbine stage is charged with the steam generated in the steam generator, whereupon the steam turbine system develops a part power. By virtue of the fact that the steam temperature required for proper flow through the colder turbine stage is lower than for proper flow through the hotter turbine stage, the steam turbine system can accordingly be started up earlier in dependence on the temperature difference between the respective turbine stages, which normally implies a substantial reduction in the delay time. According to the embodiment of the invention, only once the temperature of the steam generated in the steam generator has reached the predetermined temperature, which at least corresponds to the temperature requirement for the turbine stage having a higher starting temperature, is the hotter turbine stage also charged, whereupon the steam turbine system can develop full power. In addition to the above-mentioned reduction in delay time, a further advantage of the start-up method according to the embodiment of the invention is that this has no negative effect on the service life of the steam turbine system.

Preferably, until the predetermined temperature has been reached, and in order to reduce the ventilation power, the turbine stage having a higher starting temperature is connected to the condenser such that barrier steam fed into the turbine stage having a higher starting temperature is routed into the condenser, where it is condensed. This ensures that the ventilation power is permissibly low.

According to one embodiment of the method according to the invention, until the predetermined temperature has been reached, the steam generated in the steam generator is routed through a bypass line, which bypasses the turbine stage having a higher starting temperature, to the turbine stage having a lower starting temperature.

Advantageously, the steam turbine system is configured such that the turbine stage having a higher starting temperature is a high-pressure stage.

BRIEF DESCRIPTION

Some of the embodiments will be described in detail, with reference to the following figures, wherein like designations denote like members, wherein:

BRIEF DESCRIPTION FIG. 1 shows an embodiment of a steam turbine system used in the method disclosed herein.

DETAILED DESCRIPTION

Referring to FIG. 1, the steam turbine system 1 comprises a steam generator 2, a steam turbine 3 (having a high-pressure stage 4, an intermediate-pressure stage 5 and a low-pressure stage 6), a condenser 7, a reheater 8, a second steam generator 9 and a consumer 10 which is for example a generator.

The steam generator 2 is connected to the high-pressure stage 4 via a steam line 11, the steam line 11 being provided with a shut-off valve 12 which is configured to selectively shut off or open the steam line 11. The high-pressure stage 4 is connected to the reheater 8 via a cold reheater line 13. A check valve 14 provided in the cold reheater line 13 reliably prevents a volumetric flow in the direction of the high-pressure stage 4. A drainage line 15 branches off from the cold reheater line 13 and leads to the condenser 7, and can be selectively opened or shut off by means of a shut-off valve 16. A bypass line 18, which is also provided with a shut-off valve 17, extends between the steam line 11 and the cold reheater line 13, and is arranged such that it branches off upstream of the shut-off valve 12 of the steam line 11 and opens into the cold reheater line 13 downstream of the check valve 14. The reheater 8 is connected to the intermediate-pressure stage 5 via a hot reheater line 19 that can be selectively opened or shut off by means of a shut-off valve 20. A bypass line 22, which is also provided with a shut-off valve 21, branches off from the hot reheater line 19 and leads to the condenser 7. The intermediate-pressure stage 5 is connected to the low-pressure stage 6 via a connecting line 23. A steam line 24, via which steam generated by the second steam generator 9 can be routed into the connecting line 23 to the low-pressure stage 6, opens into the connecting line 23. The steam line 24 is provided with a check valve 25 that blocks a flow of steam in the direction of the second steam generator 9. A bypass line 27, which is provided with a shut-off valve 26, branches off from the steam line 24 and opens into the condenser 7. The low-pressure stage 6 is connected to the condenser 7 via a connecting line 28. The condenser 7 is in turn connected to the steam generator system via a condenser line 29.

After shutdown of the steam turbine system 1, the temperature of the high-pressure stage 4 or of its metallic components is higher than the temperatures of the intermediate-pressure stage 5 and of the low-pressure stage 6. When the steam turbine system 1 is again started up, the shut-off valve 12 of the steam line 11 is closed. Moreover, the shut-off valve 17 of the bypass line 18 is opened. The steam generated in the steam generator 2 is thus routed via the bypass line 18 to the reheater 8, where it is heated further and supplied thence via the hot reheater line 19 to the intermediate-pressure 5. The shut-off valve 20 of the reheater line 19 is opened while the shut-off valve 21 of the bypass line 22 is closed. Accordingly, the intermediate-pressure stage 5 is charged such that the steam turbine system 1 develops a part power. The steam issuing from the intermediate-pressure stage 5 is routed via the connecting line 23 to the low-pressure stage 6. In the process, the steam is mixed, as required, with steam generated in the second steam generator 9, via the steam line 24. Thus, the low-pressure stage 6 is also charged. The steam leaving the low-pressure stage 6 is routed via the connecting line 28 into the condenser 7, where it is condensed. The condensate is routed via the condensate line 29 back to the steam generator system. In the meantime, and in order to reduce the ventilation power, the high-pressure stage 4 is connected to the condenser 7 via the drainage line 15 by opening the shut-off valve 16, such that barrier steam introduced into the high-pressure stage 4 is routed into the condenser 7, where it is condensed.

Once the steam generated in the steam generator 2 has reached a predetermined steam temperature, which at least corresponds to the temperature of the high-pressure stage 4 and is preferably approximately 30° C. above the temperature of the high-pressure stage 4, the shut-off valve 17 of the bypass line 18 and the shut-off valve 16 of the drainage line 15 are closed and the shut-off valve 12 of the steam line 11 is opened. The steam generated in the steam generator 2 now flows via the steam line 11 to the high-pressure stage 4, in order to charge the latter. The cool steam leaving the high-pressure stage 4 is routed via the cold reheater line 13 to the reheater 8, where it is heated. The shut-off valve 16 of the drainage line 15 leading to the condenser 7 is closed at this time. Then, as has already been described, the steam heated in the reheater 8 is fed via the hot reheater line 19 to the intermediate-pressure stage 5 and then to the low-pressure stage 6.

The fact that, until the predetermined steam temperature that is required for proper charging of the high-pressure stage 4 has been reached, the steam generated in the steam generator 2 is routed past the high-pressure stage 4 to the intermediate-pressure stage 5 means that the delay time can be shortened while developing a small amount of power. Once the steam generated in the steam generator 2 has reached the predetermined temperature, the high-pressure stage 4 is connected in order that the steam turbine system 1 develops the desired power. This start-up method does not incur a reduction in the service life of the steam turbine system 1.

Although the invention has been described and illustrated in detail by way of the preferred exemplary embodiment, the invention is not restricted by the disclosed examples and other variations can be derived herefrom by a person skilled in the art without departing from the scope of protection of the invention.

The invention claimed is:

1. A method for starting up a steam turbine system having a steam generator, a steam turbine that is connected to the steam generator and comprises at least three turbine stages which have different starting temperatures when the steam turbine system is started, the method comprising:

providing a condenser that is connected to the steam turbine;

providing a reheater;

driving a consumer using the steam turbine;

generating steam in the steam generator, and using the generated steam to start the steam turbine , wherein only a turbine stage having a lower starting temperature and a turbine stage having a second lower starting temperature are operated until the steam generated in the steam generator reaches a predetermined temperature which corresponds at least to the temperature requirement of the turbine stage having a higher starting temperature;

starting the turbine stage having a higher starting temperature only once the predetermined temperature has been reached, wherein until the predetermined temperature has been reached, the steam generated in the steam generator is routed through a bypass line to the reheater, such that the reheater heats the steam and provides the heated steam to the turbine stage having the lower starting temperature; and bypassing the turbine stage having a higher starting temperature using the bypass line, to the turbine stage having the lower starting temperature, and wherein the heated steam provided to the turbine stage having the lower starting temperature is directed to the turbine stage having the second lower temperature.

2. The method as claimed in claim 1, wherein until the predetermined temperature has been reached, and in order to reduce the ventilation power, the turbine stage having a higher starting temperature is connected to the condenser such that barrier steam fed into the turbine stage having a higher starting temperature is routed into the condenser, where it is condensed.

3. The method as claimed in claim 1, wherein the turbine stage having a higher starting temperature is a high-pressure stage.

4. method as claimed in claim 1, wherein the steam turbine system comprises a second steam generator, wherein the second steam generator is connected to the turbine stage having the second lower starting temperature such that steam may issue from the turbine stage having the lower starting temperature stage to the turbine stage having the second lower starting temperature and be mixed with steam generated in the second steam generator.

5. A method for starting up a steam turbine system having a steam generator, a steam turbine that is connected to the steam generator and comprises at least two turbine stages which have different starting temperatures when the steam turbine system is started, the method comprising:

providing a condenser that is connected to the steam turbine;

providing a reheater;

driving a consumer using the steam turbine;

generating steam in the steam generator, and using the generated steam to start the steam turbine , wherein only a turbine stage having a lower starting temperature is operated until the steam generated in the steam generator reaches a predetermined temperature which corresponds at least to the temperature requirement of a turbine stage having a higher starting temperature;

starting the turbine stage having a higher starting temperature only once the predetermined temperature has been reached, wherein until the predetermined temperature has been reached;

wherein until the predetermined temperature has been reached, the steam generated in the steam generator is routed through a bypass line to the reheater, such that the reheater heats the steam and provides the heated steam to the turbine stage having the lower starting temperature;

bypassing the turbine stage having a higher starting temperature using the bypass line, to the turbine stage having the lower starting temperature; and wherein until the predetermined temperature has been reached, and in order to reduce the ventilation power, the turbine stage having a higher starting temperature is connected to the condenser such that barrier steam fed into the turbine stage having a higher starting temperature is routed directly into the condenser bypassing the turbine stage having the lower starting temperature, where it is condensed.

* * * * *